US005177966A

United States Patent [19]

Takai

[11] Patent Number: 5,177,966

[45] Date of Patent: Jan. 12, 1993

[54] FLUID PUMP ARRANGEMENT WITH FLOW REGULATION FEATURE

[75] Inventor: Yoshiki Takai, Kanagawa, Japan

[73] Assignee: Atsugi Motor Parts Co., Ltd., Japan

[21] Appl. No.: 276,458

[22] Filed: Nov. 28, 1988

[30] Foreign Application Priority Data

Nov. 26, 1987 [JP] Japan ..... 62-180186[U]

[51] Int. Cl.[5] ..... F16D 31/02

[52] U.S. Cl. ..... 60/468

[58] Field of Search ..... 60/464, 468, 494; 418/259; 417/310

[56] References Cited

U.S. PATENT DOCUMENTS

| | | | |
|---|---|---|---|
| 2,910,944 | 11/1959 | Pettibone | 417/310 X |
| 2,981,067 | 4/1961 | Clark et al. | 60/468 |
| 4,199,304 | 4/1980 | Strikis et al. | 417/310 |
| 4,373,871 | 2/1983 | Christ | 417/310 |
| 4,400,938 | 8/1983 | Ohe | 60/468 X |
| 4,408,964 | 10/1983 | Mochizuki et al. | 418/259 X |
| 4,564,338 | 1/1986 | Ilg | 417/310 |
| 4,597,718 | 7/1986 | Nakano et al. | 417/310 X |
| 4,632,204 | 12/1986 | Honaga et al. | 60/430 X |
| 4,694,927 | 9/1987 | Nagae | 60/468 X |

FOREIGN PATENT DOCUMENTS

| | | | |
|---|---|---|---|
| 1653844 | 6/1971 | Fed. Rep. of Germany | 417/310 |
| 2001614 | 7/1971 | Fed. Rep. of Germany | 417/310 |
| 79278 | 10/1982 | Japan . | |
| 180088 | 10/1984 | Japan | 418/259 |
| 48707 | 7/1987 | Japan | 418/259 |
| 246482 | 11/1987 | Japan | 418/259 |

*Primary Examiner*—Edward K. Look
*Assistant Examiner*—John Ryznic
*Attorney, Agent, or Firm*—Ronald P. Kananen

[57] ABSTRACT

A fluid pump has a rotary pressure generator means rotatingly driven by a power unit, such as an automotive engine, and variable of output pressure depending upon rotation speed of the power unit. The pressurized fluid output from the pressure generator means is supplied to a high pressure chamber which is connected to an external hydraulic device, such as an automotive steering device, via a high pressure path and a supply line. The supply line is connected to a high pressure path via a pressure regulating path. The pressure regulating path is so designed as to provide flow resistance which increases according to increasing of the fluid pressure supplied to the supply line from the high pressure path. This makes pressure variation gradient at the supply line smaller than that in the high pressure path.

18 Claims, 3 Drawing Sheets

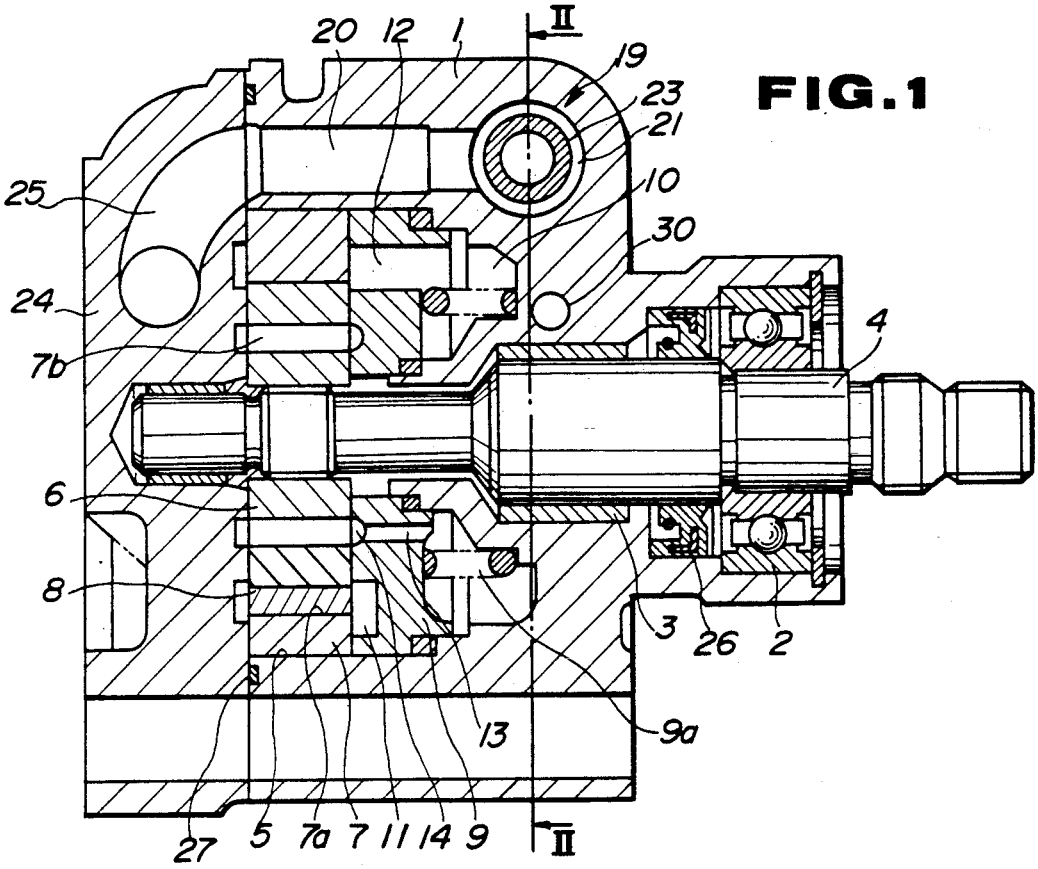
FIG.1
FIG.2
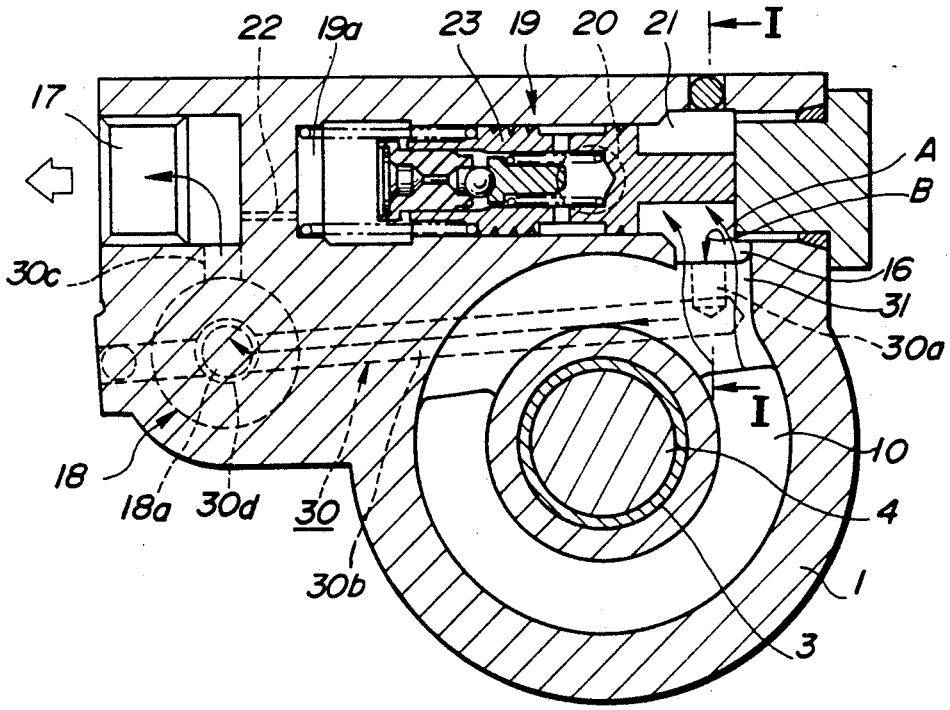

FLUID PUMP ARRANGEMENT WITH FLOW REGULATION FEATURE

BACKGROUND OF THE INVENTION

1. FielD of the Invention

The present invention relates generally to a fluid pump, such as that applicable for a hydraulic circuit of an automotive power steering device. More specifically, the invention relates to a fluid pump which can regulate a fluid flow rate of a working fluid to be supplied to a hydraulic device.

2. Description of the Background Art

One of the typical constructions of the fluid pump has been disclosed in Japanese Utility Model First (unexamined) Publication (Jikkai) Shows 57-79278. The disclosed fluid pump has a drive shaft associated with an automotive engine to be rotatingly driven by means of the latter. The drive shaft carries a rotor for rotation therewith. The rotor is rotatably disposed within a cam ring. The rotor is formed with a plurality of essentially radially extending grooves. A plurality of vanes are thrustingly disposed within the grooves so as to move toward and away from the inner periphery of the cam ring. The vanes projecting from the grooves and are in sliding contact with the inner periphery of the cam ring defining a working chamber between the adjacent vanes. As is well known, the cam ring is formed on an oval or elliptic configuration so as to define two sets of induction ranges for increasing working chamber volume to introduce the working fluid and a compression range for decreasing working chamber volume to pressurize the working fluid within the working chamber. The working chamber at a predetermined angular position communicates with a high pressure chamber. Part of the pressurized fluid is introduced into the vane grooves from radial insides of the rotor so as to bias the vanes toward the inner periphery of the cam ring.

The high pressure chamber is connected to a supply line connected to an external hydraulic device, such as the automotive power steering device to supply the pressurized fluid therethrough. The supply line is connected to a high pressure path. The high pressure path is connected to a low pressure chamber via a flow control valve. The high pressure path is also connected to a spool chamber. A spool valve disposed within the spool chamber is operable in response to the internal pressure within the spool chamber and a pressure in a pressure responsive orifice. By this construction excessive pressure in the high pressure chamber is fed back to the low pressure chamber.

In such a fluid pump arrangement, the supply line is connected to the high pressure path in the vicinity of the high pressure chamber in a direction perpendicular to the flow direction of the working fluid in the high pressure chamber. With such construction, the discharge rate of the fluid pump is increased proportional to the engine revolution speed. When increasing the flow amount to be discharged, the fluid pressure in the high pressure chamber serves as resistance. Therefore, the pressure difference between the fluid pressure in the spool chamber and the pressure responsive orifice becomes greater to cause a greater gradient of pressure variation. This causes a substantial variation of the fluid pressure to be supplied to the hydraulic device when engine speed varies due to gear shifting. Therefore, flow control by means of a pressure control valve in a power steering control circuit becomes unstable to cause degradation of the vehicular steering characteristics.

SUMMARY OF THE INVENTION

Therefore, it is an object of the present invention to provide a fluid pump arrangement which can solve the defect in the prior art set forth above.

Another and more specific object of the present invention is to provide a fluid pump which can reduce a pressure variation gradient to moderately vary the fluid pressure.

A further object of the invention is to provide a fluid pump which can achieve moderate variation of fluid pressure in relation to revolution speed of a driving power source, such as an automotive engine, with a simple construction.

In order to accomplish the aforementioned and other objects, a fluid pump, according to the present invention, has a supply line connected to a high pressure path via a pressure regulating path. The pressure regulating is so designed as to provide a flow resistance which increases according to an increasing of the fluid pressure supplied to the supply line from the high pressure path. This makes a pressure variation gradient at the supply line smaller than that in the high pressure path.

In the preferred embodiment, the pressure regulating path is formed into an essentially U-shaped configuration connected to the supply line at one end and to the high pressure path at the other end.

According to one aspect of the invention, a fluid pump arrangement comprises:

a pressurized fluid source means, associated with a driving power unit which has variable driving characteristics, for introducing a working fluid into a working chamber and discharging pressurized fluid, the pressurized fluid source means having a pressure output characteristic to vary pressure of the pressurized fluid according to variation of the driving characteristics of the power unit;

a high pressure path means connected to the pressurized fluid source means for receiving the pressurized fluid therefrom;

a supply path connected to a hydraulically operable work for supplying a controlled amount of pressurized fluid; and a pressure regulating path connecting the high pressure path and the supply path to feed the pressurized fluid from the high pressure path to the supply path, the pressure regulating path having a flow restriction characteristic for increasing pressure loss therein according to increasing of the fluid pressure in the high pressure path.

In the preferred constructions, the fluid pump arrangement may further comprise a fluid return path means for feeding back part of the pressurized fluid when the pressure of the working fluid supplied through the high pressure path is excessive. The fluid return path means is connected to an inlet of the pressurized fluid source means.

On the other hand, the fluid pump arrangement may further comprise a flow control valve means responsive to a pressure difference between a pressure supplied from the high pressure path and a pressure supplied to the hydraulically operable work.

The pressure regulating path means includes a throttle for restricting fluid flow through the high pressure path. The pressure regulating path means may also include a portion connected to the inlet of the supply path to flow the pressurized working fluid in a direction opposite to the fluid flow direction in the high pressure path.

According to another aspect of the invention, a fluid pump arrangement comprises:

a rotary pressurized fluid source means, associated with a rotary driving power unit which has variable rotational driving characteristics, for introducing a working fluid into a working chamber and discharging pressurized fluid, the pressurized fluid source means having a rotating characteristic having variable pressure output characteristics depending upon rotating speed thereof, and the rotary pressure fluid source means having a rotation speed variation characteristic according to variations of the rotational driving characteristics of the power unit;

a high pressure path means connected to the pressurized fluid source means for receiving the pressurized fluid therefrom;

a supply path connected to a hydraulically operable work for supplying a controlled amount of pressurized fluid; and a pressure regulating path connecting the high pressure path and the supply path to feed the pressurized fluid from the high pressure path to the supply path, the pressure regulating path having flow restriction characteristics for increasing pressure loss therein according to an increase of the fluid pressure in the high pressure path.

According to a further aspect of the invention, a fluid pump arrangement for an automotive power steering device for creating hydraulic force assisting automotive steering operation, comprises:

a pressurized fluid source means, associated with an automotive engine which has variable driving characteristics, for introducing a working fluid into a working chamber and discharging pressurized fluid, the pressurized fluid source means having a pressure output characteristic to vary pressure of the pressurized fluid depending upon the revolution speed of the automotive engine;

a high pressure path means connected to the pressurized fluid source means for receiving the pressurized fluid therefrom;

a supply path connected to a hydraulically operable work for supplying a controlled amount of pressurized fluid; and a pressure regulating path connecting the high pressure path and the supply path to feed the pressurized fluid from the high pressure path to the supply path, the pressure regulating path having a flow restriction characteristic for increasing pressure loss therein according to an increase of the fluid pressure in the high pressure path.

BRIEF DESCRIPTION OF THE DRAWINGS

The present invention will be understood from the detailed discussion of the present invention given herebelow and from the accompanying drawings of the preferred embodiment of the invention, which, however, should not be taken to limit the invention to the specific embodiments but are for explanation and understanding only.

In the drawings:

FIG. 1 is a cross section of the preferred embodiment of a fluid pump, according to the present invention, which is taken at a plane extending through an axis of a drive shaft;

FIG. 2 is a section taken along line II—II of FIG. 1;

DESCRIPTION OF THE PREFERRED EMBODIMENT

Figure 3:
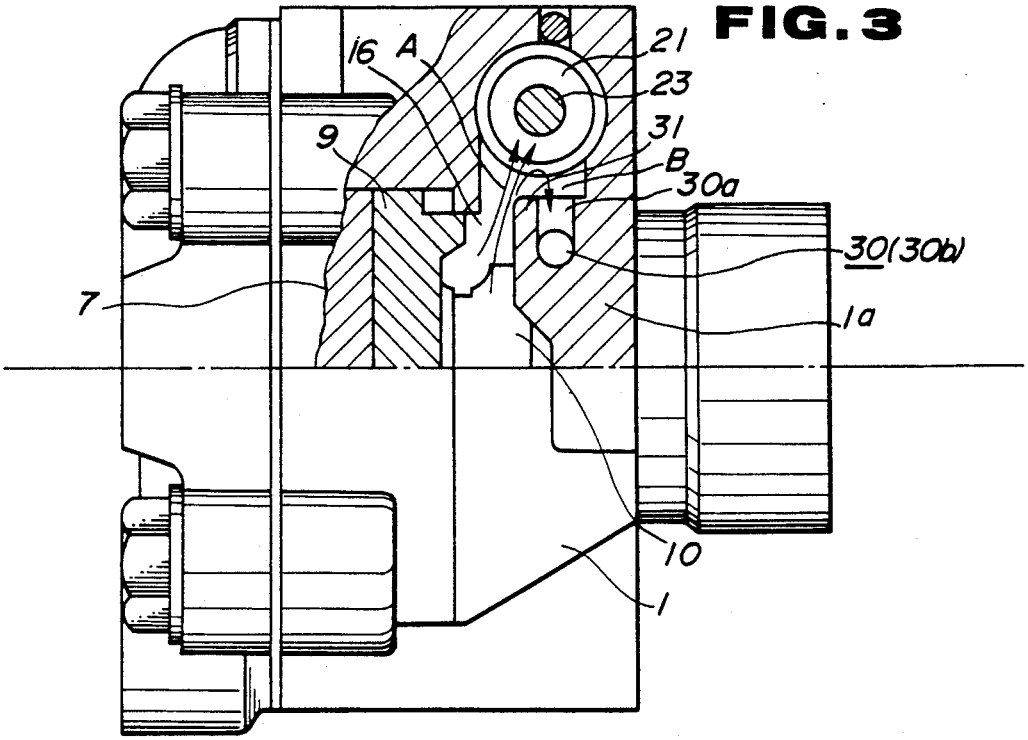
FIG. 3 is a partially-sectioned side elevation of the preferred embodiment of the fluid pump, in which the section is taken along a plane essentially parallel to the place at which the section of FIG. 1 is taken, but offset therefrom.

Referring now to the drawings particularly to FIGS. 1 and 2, the preferred embodiment of a fluid pump, according to the present invention, will be discussed herebelow in a form applied as a working fluid source for an automotive power steering device. The power steering device, herewith discussed, is associated with an electrically operable solenoid for varying a pressure supply for a steering unit depending upon vehicle driving speed for reducing the pressure supply for the steering unit in order to reduce assisting force according to an increase of the vehicular speed for vehicular driving stability.

In the preferred embodiment, the fluid pump, according to the present invention has a pump housing 1 which is formed with a circular recess 5 which is exposed to the outside from one axial end of the housing. An assembly of a rotor 6 and a cam ring 7 is disposed within the recesses orienting to a plane substantially flush to the axial end of the housing. The rotor 6 is splined to a drive shaft 4 which is driven by means of an automotive engine (not shown). The drive shaft 4 is rotatably supported on the pump housing 1 by means of bearings 2 and 3. Therefore, the rotor 6 is driven to rotate with the drive shaft 4 in synchcronism with the revolution of the automotive engine.

The rotor 6 is formed with a plurality of essentially radial rotor grooves extending radially and inwardly from the circumference thereof. To each radial groove, a rotor vane 8 is thrustingly disposed. The rotor vane 8 is thrustingly movable. The circumference of the rotor 6 opposes an inner peripheral cam face 7*a*. The rotor vanes 8 are radially movable toward and away from the cam face 7*a* of the cam ring 7. The rotor vanes 8 are projected from the rotor grooves and establish tip contact with the cam face 7*a* defining a working fluid chamber which is not clearly shown in the drawings. As is well known in the vane pump technologies, the cam ring 7 is formed in an oval or an elliptic configuration so as to define two sets of induction zones and compression zones in cooperation with the outer circumference of the rotor 6 and the rotor vanes. Namely, with the oval or elliptic configuration of the inner space, the volume of the working fluid chamber is gradually increased in the induction zone to introduce a working fluid into the working fluid chamber. On the other hand, in the compression zone, the volume of the working fluid chamber is gradually reduced so as to compress the internal fluid to generate a fluid pressure.

The inside axial end of the assembly of the rotor 6 and the cam ring 7 is closed by a side plate 9. The side plate 9 is resiliently biased toward the opposing end of the assembly of the rotor and the cam ring by means of a resilient coil spring 9*a*. The side plate 9 is cooperative with the inner periphery of the recess 5 of the pump housing 1 to define a high pressure chamber 10 between the bottom of the recess and the side plate. The high pressure chamber 10 is communicated with an annular groove 11 which is in communication with the working fluid chamber in the assembly of the rotor 6 and the cam ring 7 at discharge points set at specific angular positions, via a discharge path 12 which is formed through the side plate 9. Via the annular groove 11 and the discharge path 12, all of the pressurized fluid in the working fluid chambers of the rotor and cam ring assembly is fed into the high pressure chamber 10.

The side plate 9 is also formed with a plurality of axially extending openings 13 which are oriented in a circumferential alignment and radially inside of the discharge path 12. The openings 13 have inner ends communicated with the high pressure chamber 10. On the other hand, the openings 13 have outer ends opposing the axial inner end of the rotor and cam ring assembly and communicated with arc shaped grooves 14 formed on the plane of the side plate 9 opposing the rotor and cam ring assembly. The arc shaped grooves 14 are respectively communicated with axially extending openings 7*b* formed through the rotor 6 in circumferential alignment and at an orientation which is radially and inwardly offset in relation to the bottom of the rotor grooves. Though it is not clearly shown in the drawings, the openings 7*b* are connected to the bottom portion of the rotor grooves. Therefore, part of the pressurized fluid in the high pressure chamber 10 is introduced into the rotor grooves for hydraulically pressing the rotor vanes 8 toward the cam face 7*a* of the cam ring 7.

A supply path 30 is formed in the pump housing 1. As will be appreciated from FIGS. 1 and 2, the supply path 30 extends essentially perpendicular to the plane of the section in FIG. 1. The supply path 30 is connected to an external hydraulic device, i.e. the automotive power steering device in the shown embodiment. Therefore, the pressurized fluid is supplied to the hydraulic device via the supply path 30. As seen from FIGS. 2 and 3, the supply line 30 is communicated with the high pressure chamber 10 via a high pressure path 16. The supply line 30 is communicated with a discharge port 17 which is connected to the power steering device, via a solenoid valve 18.

Figure 4:
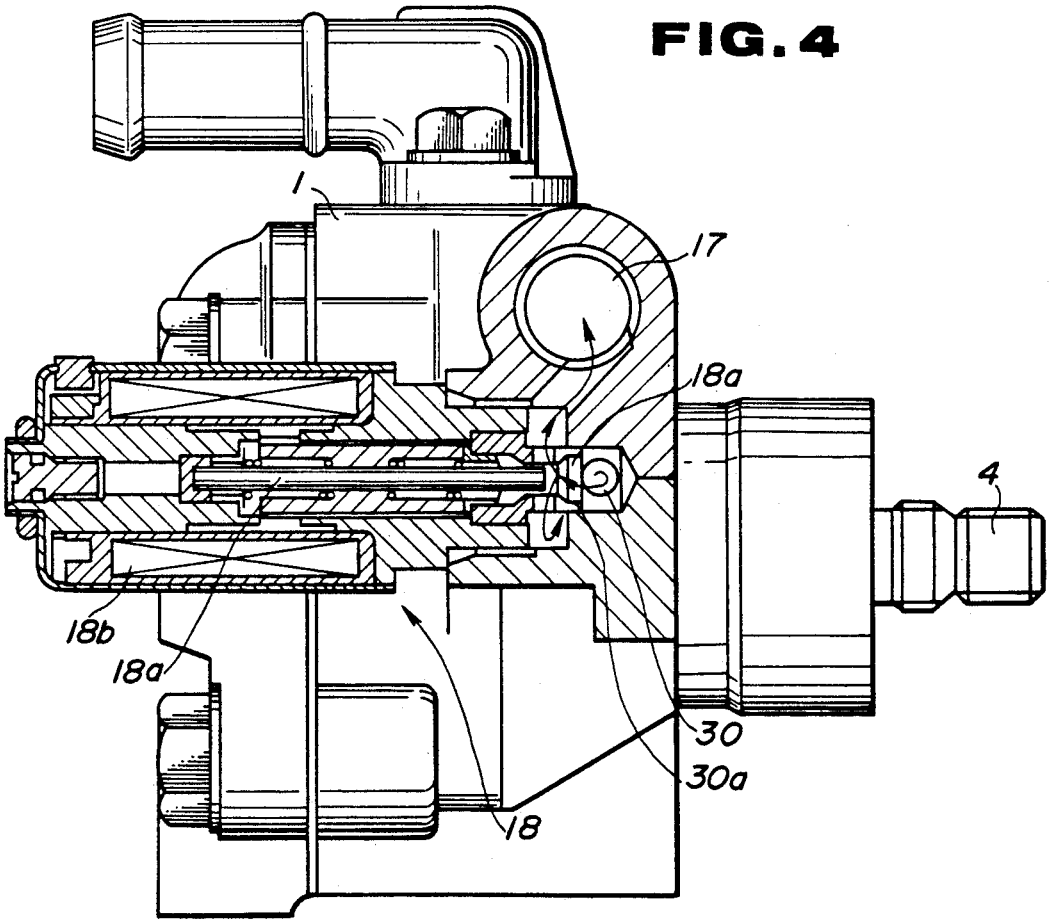
FIG. 4 is a section showing a solenoid valve employed in the preferred embodiment of the fluid pump of FIGS. 1 to 3.

As seen from FIG. 4, the solenoid valve 18 comprises defines a variable path area orifice 30*a* through which the supply line 30 and the discharge port 17 are communicated with each other. An essentially cylindrical valve body 18*a* is disposed so as to move toward and aft the variable path area orifice 30*a*. The position of the valve body 18*a* is controlled by magnitude of energization of a solenoid coil 18*b* which electromagnetically drives the valve body. The solenoid coil 18*b* may be connected to a control unit which derives energization magnitude of the solenoid coil depending upon a vehicular speed so that the working fluid pressure to be supplied to the power steering device is decreased according to increasing of the vehicle speed.

A flow control valve assembly 19 is disposed between the high pressure path 16 and a low pressure path 20. The flow control valve assembly 19 defines a spool chamber 21. As seen from FIG. 2, the flow control valve assembly 19 includes a pilot pressure chamber 19*a* communicated with the discharge chamber 17 via an orifice 22. A valve body 23 of the flow control valve assembly 19 is controlled the position depending upon the pressure difference between the pressure in the pilot pressure chamber 19*a* and the pressure in the spool chamber 21 so as to feed excessive pressure to the low pressure path 20.

The low pressure path 20 is communicated with an induction path 25 defined in a cover plate 24 which sealingly covers the open end of the recess 5 of the pump housing 1. Though it is not clearly illustrated in the drawings, the induction path 25 communicates with induction ports oriented at positions corresponding to specific angular positions of the working fluid chambers.

The supply path 30 has an inlet 30*a* opens in a groove 30*b* formed through the peripheral wall 1*a* of the pump housing 1, as shown in FIG. 3. The groove 30*b* is separated from the high pressure path 16 by a separation wall 31. As seen from FIG. 3, the groove 30*b* communicates with the spool chamber 21.

Figure 5:
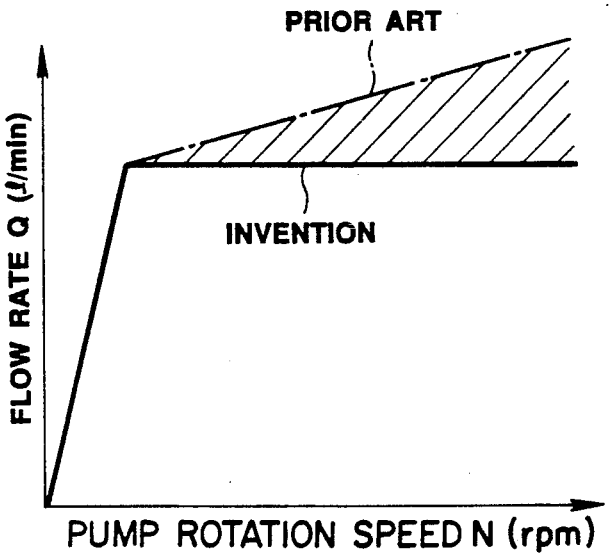
FIG. 5 is a chart showing fluid flow amount variation in relation to pump rotation speed.

The separation wall 31 narrows the path area of the high pressure path 16 for restrioting pressurized fluid flow therethrough. The pressurized fluid flowing through the high pressure path 16 normally flows in a direction as illustrated by arrow A. However, by the presence of the separation wall 31, part of the pressurized fluid is directed as shown by the arrow B opposite direction to the flow direction in the high pressure path 16. This causes pressure loss at the portion where the path area is narrowed by the separation wall 31 and where the flow direction is changed from the direction A to direction B. As will be appreciated, the magnitude of pressure loss may be increased according to increasing of the fluid pressure in the high pressure chamber 10. Therefore, as seen from FIG. 5, the pressure supplied to the solenoid valve 18 in the shown embodiment becomes essentially constant after the engine speed reaches at a predetermined value. This avoids fluid pressure variation as illustrated by the hatched area in FIG. 5.

Figure 6:
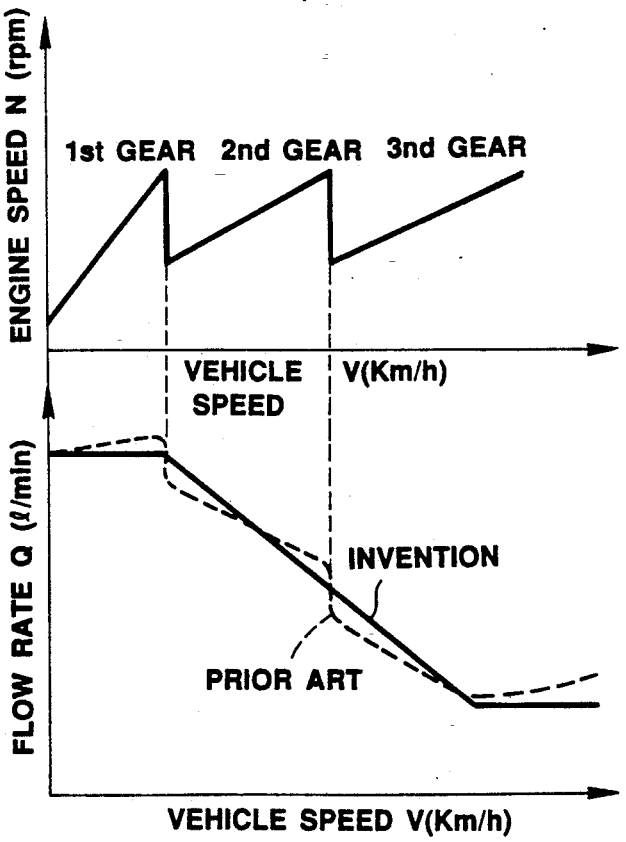
FIG. 6 is a chart showing variation of fluid flow amount in relation to vehicular speed while an automotive power transmission is shifted.

Regulating the pressure flowing through the supply line 13, allows linear variation of the working fluid flow rate to be supplied to the power steering system in relation to variation of the vehicular speed, as shown in FIG. 6. This can be compared with the working fluid flow rate variation as illustrated by broken line in FIG. 6 in the prior art, in which pressure increases with greater variation gradient as illustrated by the hatched area of FIG. 5. Namely, in the prior art, the fluid flow rate fluctuates according to engine speed variation caused by power transmission gear shifting, as can be clear from FIG. 6. In comparison of the fluid flow rate variation as shown by the broken line, the fluid flow rate variation is substantially linear. This prove success of the shown embodiment of avoidance of influence of the engine speed variation.

With the construction set forth above, the invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A fluid pump arrangement comprising:

a pressurized fluid source means, associated with a driving power unit which has variable driving characteristics, for introducing a working fluid into a working chamber and discharging pressurized fluid, said pressurized fluid source means having pressure output characteristics to vary the pressure of said pressurized fluid according to the variation of said driving characteristics of said power unit;

a high pressure path means connected to said pressurized fluid source means for receiving the pressurized fluid therefrom;

a supply path connected to a hydraulically operable work for supplying a controlled amount of pressurized fluid;

a pressure regulating path means connecting said high pressure path and said supply path to feed the pressurized fluid from said high pressure path to said supply path, said pressure regulating path means having flow restriction characteristics for increasing pressure loss therein according to increases of the fluid pressure in said high pressure path;

a flow control valve means responsive to a pressure difference between a pressure supplied from said high pressure path and a pressure supplied to said hydraulically operable work; and said pressure regulating path means including a portion connected to the inlet of said supply path to flow the pressurized working fluid in a direction opposite to the fluid flow direction in said high pressure path so as to obtain said flow restriction characteristics and to reduce fluctuations in flow rate of the pressurized working fluid supplied from said high pressure path to said supply path.

2. A fluid pump arrangement as set forth in claim 1, which further comprises a fluid return path means for feeding back a part of pressurized fluid when the pressure of the working fluid supplied through said high pressure path is excessive.

3. A fluid pump arrangement as set forth in claim 2, wherein said fluid return path means is connected to an inlet of said pressurized fluid source means.

4. A fluid pump arrangement as set forth in claim 1, wherein said pressure regulating path means includes a throttle for restricting fluid flow through said high pressure path.

5. A fluid pump arrangement as set forth in claim 1, wherein said portion connected to said inlet of said supply line is separated from said high pressure path by means of a partitioning wall.

6. A fluid pump arrangement as set forth in claim 5, wherein said partitioning wall serves as a throttle for restricting fluid flow through said high pressure path.

7. A fluid pump arrangement comprising:

a rotary pressurized fluid source means, associated with a rotary driving power unit which has variable rotational driving characteristics, for introducing a working fluid into a working chamber and discharging pressurized fluid, said pressurized fluid source means having rotating characteristics that vary the pressure output characteristics depending upon rotating speed thereof, and said rotary pressure fluid source means having rotating speed variation characteristics that vary according to variation of said rotational driving characteristics of said power unit;

a high pressure path means connected to said pressurized fluid source means for receiving the pressurized fluid therefrom;

a supply path connected to a hydraulically operable work for supplying a controlled amount of pressurized fluid;

a pressure regulating path means connecting said high pressure path and said supply path to feed the pressurized fluid from said high pressure path to said supply path, said pressure regulating path means having flow restriction characteristics for increasing pressure loss therein according to increases of the fluid pressure in said high pressure path;

a flow control valve means responsive to a pressure difference between a pressure supplied from said high pressure path and a pressure supplied to said hydraulically operable work; and said pressure regulating path means including a portion connected to the inlet of said supply path to flow the pressurized working fluid in a direction opposite to the fluid flow direction in said high pressure path so as to obtain said flow restriction characteristics and to reduce fluctuations in flow rate of the pressurized working fluid supplied from said high pressure path to said supply path and thereby facilitating control of flow amount of the working fluid.

8. A fluid pump arrangement as set forth in claim 7, which further comprises a fluid return path means for feeding back a part of pressurized fluid when the pressure of the working fluid supplied through said high pressure path is excessive.

9. A fluid pump arrangement as set forth in claim 8, wherein said fluid return path means is connected to an inlet of said pressurized fluid source means.

10. A fluid pump arrangement as set forth in claim 7, wherein said pressure regulating path means includes a throttle for restrioting fluid flow through said high pressure path.

11. A fluid pump arrangement as set forth in claim 7, wherein said portion connected to said inlet of said supply line is separated from said high pressure path by means of a partitioning wall.

12. A fluid pump arrangement as set forth in claim 11, wherein said partitioning wall serves as a throttle for restricting fluid flow through said high pressure path.

13. A fluid pump arrangement for an automotive power steering device for creating hydraulic force assisting automotive steering operation in an automotive having an automotive engine, comprising;

a pressurized fluid source means, associated with an automotive engine which has variable driving characteristics, for introducing a working fluid into a working chamber and discharging pressurized fluid, said pressurized fluid source means having pressure output characteristics that vary the pressure of said pressurized fluid depending upon the revolution speed of said automotive engine;

a high pressure path means connected to said pressurized fluid source means for receiving the pressurized fluid therefrom;

a supply path connected to a hydraulically operable work for supply a controlled amount of pressurized fluid;

a pressure regulating path means connecting said high pressure path and said supply path to feed the pressurized fluid from said high pressure path to said supply path, said pressure regulating path means having flow restriction characteristics for increasing pressure loss therein according to increases of the fluid pressure in said high pressure path;

a flow control valve means responsive to a pressure difference between a pressure supplied from said high pressure path and a pressure supplied to said hydraulically operable work; and said pressure regulating path means including a portion connected to the inlet of said supply path to flow the pressurized working fluid in a direction opposite to the fluid flow direction in said high pressure path so as to obtain said flow restriction characteristics and to reduce fluctuations in flow rate of the pressurize working fluid supplied from said high pressure path to said supply path.

14. A fluid pump arrangement as set forth in claim 13, which further comprises a fluid return path means for feeding back a part of pressurized fluid when the pressure of the working fluid supplied through said high pressure path is excessive.

15. A fluid pump arrangement as set forth in claim 14, wherein said fluid return path means is connected to an inlet of said pressurized fluid source means.

16. A fluid pump arrangement as set forth in claim 13, wherein said pressure regulating path means includes a throttle for restricting fluid flow through said high pressure path.

17. A fluid pump arrangement as set forth in claim 13, wherein said portion connected to said inlet of said supply line is separated from said high pressure path by means of a partitioning wall.

18. A fluid pump arrangement as set forth in claim 17, wherein said partitioning wall serves as a throttle for restricting fluid flow through said high pressure path.

* * * * *